US006630930B2

(12) United States Patent
Kashiwada

(10) Patent No.: US 6,630,930 B2
(45) **Date of Patent: *Oct. 7, 2003**

(54) DRIVE CIRCUIT AND DISPLAY UNIT FOR DRIVING A DISPLAY DEVICE AND PORTABLE EQUIPMENT

(75) Inventor: Junji Kashiwada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/062,532

(22) Filed: Feb. 5, 2002

(65) Prior Publication Data

US 2002/0093500 A1 Jul. 18, 2002

Related U.S. Application Data

(62) Division of application No. 09/261,120, filed on Mar. 3, 1999, now Pat. No. 6,369,808.

(30) Foreign Application Priority Data

May 11, 1998 (JP) ..... 98-127349

(51) Int. Cl.[7] ..... G09G 5/00

(52) U.S. Cl. ..... 345/204; 345/205; 345/206; 345/207; 345/208; 345/209; 345/210; 345/132

(58) Field of Search ..... 345/204, 205, 345/206, 207, 208, 209, 210, 132

(56) References Cited

U.S. PATENT DOCUMENTS

| | | | |
|---|---|---|---|
| 5,694,155 | A | 12/1997 | Stapleton et al. |
| 5,841,431 | A | 11/1998 | Simmers |
| 6,088,014 | A | 7/2000 | Furuhashi et al. |
| 6,100,867 | A | 8/2000 | Gyouten |

FOREIGN PATENT DOCUMENTS

| | | |
|---|---|---|
| JP | 57-11396 | 1/1982 |
| JP | 3-196092 | 8/1991 |
| JP | 5-297817 | 11/1993 |
| JP | 5-333816 | 12/1993 |

*Primary Examiner*—Richard Hjerpe
*Assistant Examiner*—Jean Lesperance
(74) *Attorney, Agent, or Firm*—Volentine Francos, PLLC

(57) ABSTRACT

A drive circuit for driving a display device includes a voltage level shift circuit which receives a control signal and a data signal and which shifts a voltage level of the control signal and the data signal to output a voltage level shifted control signal and a voltage level shifted data signal. The drive circuit also includes an output circuit which receives the voltage level shifted data signal and which outputs an output data signal corresponding to the voltage level shifted data signal in response to the voltage level shifted control signal.

15 Claims, 12 Drawing Sheets

DRIVE CIRCUIT AND DISPLAY UNIT FOR DRIVING A DISPLAY DEVICE AND PORTABLE EQUIPMENT

CROSS-REFERENCE TO RELATED APPLICATIONS

This is a divisional of application Ser. No. 09/261,120, filed Mar. 3, 1999, now U.S. Pat. No. 6,369,808 which is incorporated herein by reference in its entirety.

BACKGROUND OF THE INVENTION

1. Field of the Invention

The present invention generally relates to a drive circuit and a display unit, and more particularly, to a drive circuit and a display unit for controlling a display operation of a display device. Such a display device has a flat type panel and is used in portable equipment.

This application is a counterpart of Japanese patent application, Serial Number 127349/1998, filed May 11, 1998, the subject matter of which is incorporated herein by reference.

2. Description of the Related Art

Equipment having a display device, such as personal computers and word processors, are used in various fields. A flat panel type display device is often used in such equipment. This type of display device is also used in the portable telephone (or the mobile telephone). Flat panel type display devices include liquid crystal display devices, plasma display devices and devices using an electroluminescence phenomenon. The liquid crystal display device is the most commonly used. Recently, many types of equipment, such as the personal computer and the word processor, have become portable.

A drive circuit is used for driving a display panel part (for controlling the display operation) of the display device. For example, in the case of the liquid crystal display device, the drive circuit has a source driver arranged along one side (the long side of the rectangular display) of a TFT (Thin Film Transistor) display panel, and a gate driver arranged along the other side (the short side of the rectangular display panel) of the TFT display panel. The gate driver has a shift register which stores input data signals sequentially and outputs the stored data in parallel form, a level converting circuit (or a level shift circuit) which converts the signals from the shift register, and an output driver which adjusts the signals from the level converting circuit and outputs the thus adjusted signals. Such gate drivers are used for driving the display panel part. The conventional drive circuit, for example, is described in Japanese laid open patent No. 5-297817.

For example, the level converting circuit, which is one element of the gate driver, converts the respective levels of the output signals from the shift register. The level converting circuit converts voltage levels ranging from 0 v (ground voltage) to 5 v (power supply voltage) to voltage levels ranging from 0 v to 30 v. Hence, the level converting circuit consumes a lot of current according to the operation thereof In fact, the level converting circuit is the element that consumes the most current in the gate driver. As mentioned above, using a plurality of gate drivers is necessary to drive the display panel part. A reduction in the current consumption of the gate driver is desired to thereby reduce the total current consumption of the display device as a whole. However, there have been no effective measures to satisfy this requirement in conventional techniques.

Even if the current consumption can be reduced, increasing the number of elements for driving the display device by adding a complex circuit to the display device must be avoided. Also to be avoided is increasing the cost by adopting complex development and process schemes. Furthermore, even if the current consumption can be reduced, the performance of the driving elements of the display device should not deteriorate.

In equipment having a battery-operated display device, there has been a strong demand to reduce current consumption.

SUMMARY OF THE INVENTION

It is an object of the present invention to provide a drive circuit that may reduced current consumption.

It is another object of the present invention to provide such a drive circuit without increasing the number of elements.

It is another object of the present invention to provide such a drive circuit without complex development.

It is another object of the present invention to provide such a drive circuit without using complex manufacturing processes.

It is another object of the present invention is to provide such a drive circuit whose performance is not deteriorated.

According to one aspect of the present invention, for achieving the above object, there is provided a drive circuit for driving a display device includes a voltage level shift circuit which receives a control signal and a data signal and which shifts a voltage level of the control signal and the data signal to output a voltage level shifted control signal and a voltage level shifted data signal. The drive circuit also includes an output circuit which receives the voltage level shifted data signal and which outputs an output data signal corresponding to the voltage level shifted data signal in response to the voltage level shifted control signal.

The above and further objects and novel features of the invention will more fully appear from the following detailed description, appended claims and the accompanying drawings.

DETAILED DESCRIPTION OF THE PREFERRED EMBODIMENTS

First Embodiment

A drive circuit and a display unit according to the present invention will be explained hereinafter with reference to the figures.

Figure 1:
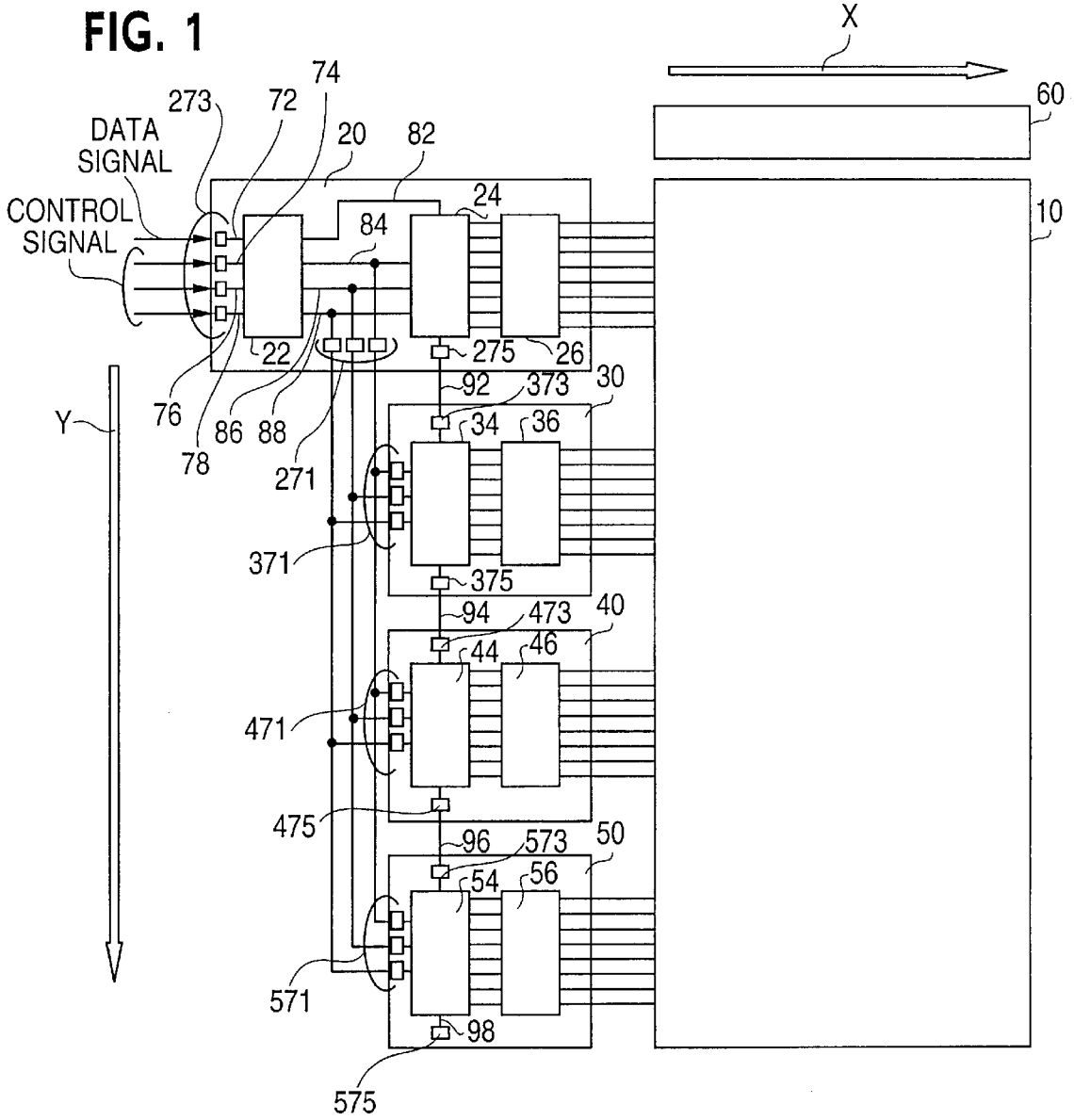
FIG. 1 is a block diagram of a drive circuit and a display unit according to a first preferred embodiment.

FIG. 1 is a block diagram showing a display device that has a display panel part 10 and a drive part for the panel 10 according to a first preferred embodiment of the present invention. In the embodiment, the display panel part 10 is a TFT liquid crystal display panel.

In FIG. 1, the drive part for driving the display panel part 10 has a source driver 60 which is arranged along a display signal direction of the display panel part 10 illustrated as an arrow X. The drive part also has gate drivers 20, 30, 40 and 50 which are arranged along a scanning direction of the display panel part 10 illustrated as an arrow Y Each of the gate drivers 20, 30, 40 and 50 is integrated into a single chip. In FIG. 1, the source driver 60 and the display panel part 10 are shown concisely. That is, an actual device has a plurality of source drivers, however, only one source driver is shown in FIG. 1. In the preferred embodiment, each of the gate drivers 20, 30, 40 and 50 is called the drive circuit. A combination of the display panel part 10, the source driver 60 (including omitted source drivers) and the gate drivers 20, 30, 40 and 50 is called a display unit. There are groups of gate drivers, each group having the same gate drivers 20, 30, 40 and 50, as those of the other display units.

The gate driver 20, as a first drive circuit, is comprised of a level shifter 22 (a level converting means), a shift register 24 (a data storing means), an output driver 26 (a driving means), input pads 273, an output pad 275, and output pads 271.

The level shifter 22 is connected between wirings 72, 74, 76 and 78 and wirings 82, 84, 86 and 88. The wiring 72 receives a data signal (a display data) from one of the input pads 273. The wiring 74 receives a clock signal from one of the input pads 273. The wiring 76 receives a shift direction control signal for controlling the shift direction of a shift register 24 from one of the input pads 273. The wiring 78 receives an output enable signal which enables/disables the shift register 24 from outputting an output signal from one of the input pads 273. The level shifter 22 converts (shifts) the level of the data signal on the wirings 72 and outputs the level converted (shifted) data signal to the wiring 82. The level shifter 22 also converts (shifts) the level of the signals on the wirings 74 to 78 and outputs the level converted (shifted) signals to the wiring 84 to 88 respectively.

The shift register 24 is connected to the wirings 82, 84, 86 and 88. The wiring 82 receives the level converted data signal. The wiring 84 receives the level converted clock signal. The wiring 86 receives the level converted shift direction control signal. The wiring 88 receives the level converted output enable signal. In the preferred embodiment, the clock signal, the shift direction control signal and the output enable signal are collectively called a control signal. The shift direction control signal and the output enable signal are not necessarily for driving the display panel part 10. That is, these signals are optional. The preferred embodiment uses a control signal that has three signals, but is not limited to such use of three signals. That is, other signals may be added to the control signal.

Figure 2:
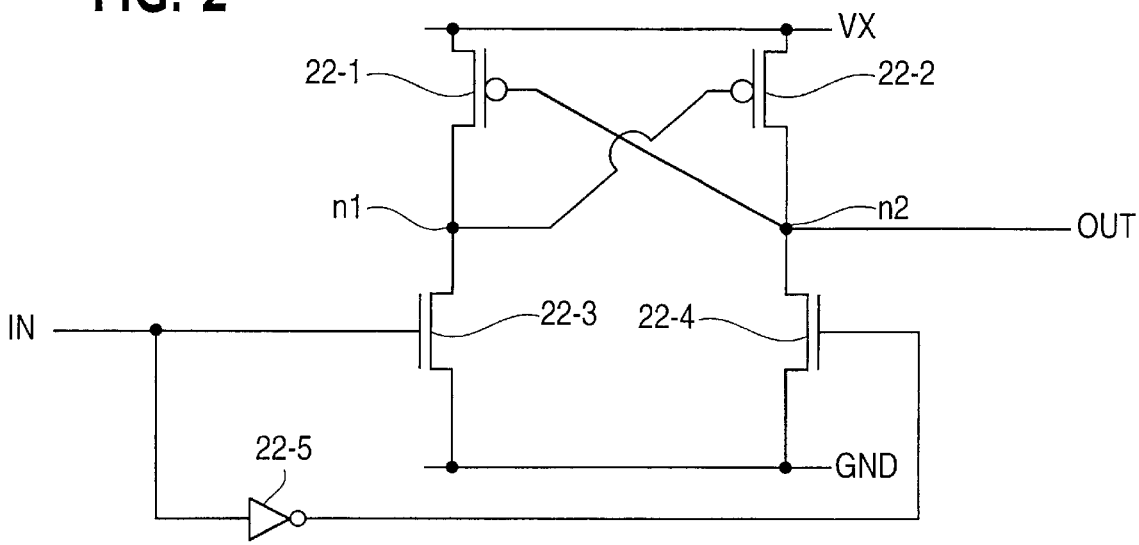
FIG. 2 is a partial circuit diagram of the level shifter.

FIG. 2 shows a partial circuit diagram of the level shifter 22. The level shifter 22 is comprised of p-channel type MOS transistors 22-1, 22-2, n-channel type MOS transistors 22-3, 22-4 and an inverter 22-5. The transistor 22-1 has one electrode receiving high voltage VX (the high voltage is, for example, 30V), another electrode connected to a node n1, and a gate electrode connected to a node n2. The transistor 22-2 has one electrode receiving the high voltage VX another electrode connected to the node n2, and a gate electrode connected to the node n1. The transistor 22-3 has one electrode receiving ground voltage GND (the ground voltage is, for example, 0V), another electrode connected to the node n1, and a gate electrode receiving an input signal (the input signal is, for example, transferred from the wiring 72). The transistor 22-4 has one electrode applied to the ground voltage GND, another electrode connected to the node n2, and a gate electrode receiving an inverted input signal. The inverter 22-5 has an input terminal receiving the input signal and an output terminal outputting the inverted input signal. The node 12 is used for an output terminal OUT of the level shifter 22. The input terminal of the inverter 22-5 is used for an input terminal IN of the level shifter 22.

The operation of the level shifter 22 as shown in FIG. 2 will be explained hereinafter.

The input signal having voltage levels ranging from 0 v to 5 v is transferred from the wiring 72 to the input terminal IN. When an input signal of 5 v is applied to the gate of the transistor 22-3, the transistor 22-3 becomes conductive. Therefore, the voltage level of the node n1 becomes 0v, which causes the transistor 22-2 to become conductive. Since the transistor 22-2 is conductive, the voltage level of the node n2 becomes the high voltage level VX. At this time, the transistors 22-1 and 22-4 are nonconductive.

On the other hand, when an input signal of 0 v is applied to the gate of the transistor 22-3, the transistor 22-4 becomes conductive instead of the transistor 22-3. Therefore, the voltage level of the node n2 becomes 0 v, which causes the transistor 22-1 to become conductive instead of the transistor 22-2. Since the transistor 22-1 is conductive, the voltage level of the node n1 becomes the high voltage level VX. At this time, the transistors 22-2 and 22-3 are nonconductive.

As mentioned above, the level shifter 22 can convert voltage levels ranging from 0 v through 5 v to voltage levels ranging from 0 v through VX (VX is, for example, 30 v). The level shifter 22 has a plurality of circuits as shown in FIG. 2. The number of such circuits corresponds to the number of such inputted signals. In the preferred embodiment, for example, the level shifter 22 has four circuits of the type shown in FIG. 2. That is, each of these circuits converts the level of the signals which are transferred from wirings 72 through 78 respectively.

The signals converted by the level shifter 22 are transferred to the shift register 24 through the wirings 84, 86 and 88. The converted control signal on the wirings 84, 86 and 88 can be output externally. That is, the drive circuit 20 has the output pads 271 which output the level converted control signal on the wirings 84, 86 and 88.

Figure 3:
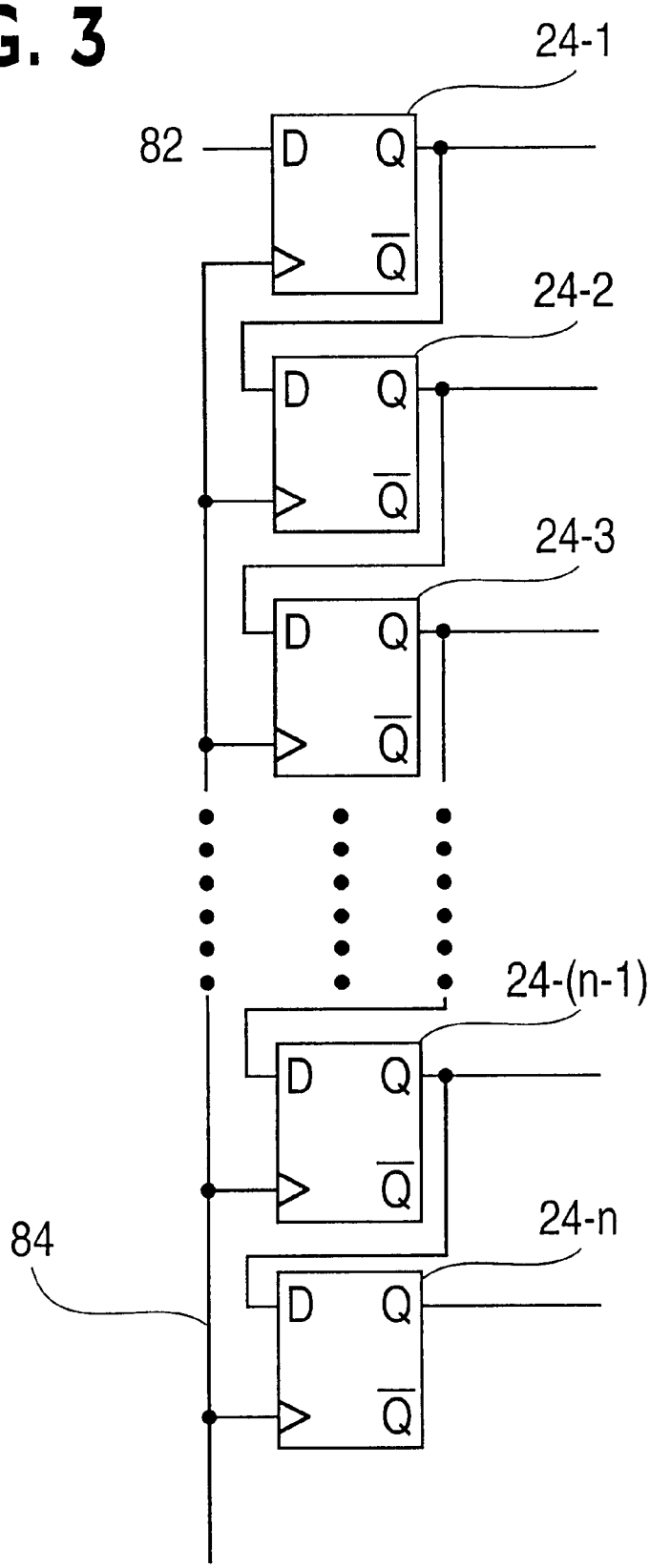
FIG. 3 is a circuit diagram of the shift register 24.

FIG. 3 shows a circuit diagram of the shift register 24. In this embodiment, the optional elements related to the shift direction control signal from the wiring 86 and the output enable signal from the wiring 88 are not used.

The shift register 24 is comprised of flip-flops 24-1 to 24-n (the symbol n is a positive integer) which store data signals respectively. The data signal having the converted level is inputted to a data terminal D of the flip-flop 24-1. The converted level means the level of the signal which is converted by the level shifter 22. The level converted data signal is transferred through the wiring 82. The flip-flop 24-1 stores the data signal and outputs the stored data signal from an output terminal Q in response to the falling edge of the level converted clock signal. The level converted clock signal is transferred through the wiring 84. The output terminal Q of the flip-flop 24-1 is connected to a data terminal D of the flip-flop 24-2 next to the flip-flop 24-1. A flip-flop 24-k (k is a positive integer of 2 or more and n or less) stores the data signal and outputs the stored data signal from an output terminal Q in response to the falling edge of the level converted clock signal in the same manner as the flip-flop 24-1 does. Each output terminal of flip-flops 24-2 to 24-(n−1) is connected to the data terminal D of the next flip-flop.

The shift register 24 outputs the output signals, which correspond to the input data signal, in parallel form in response to the clock pulse.

Figure 4A:
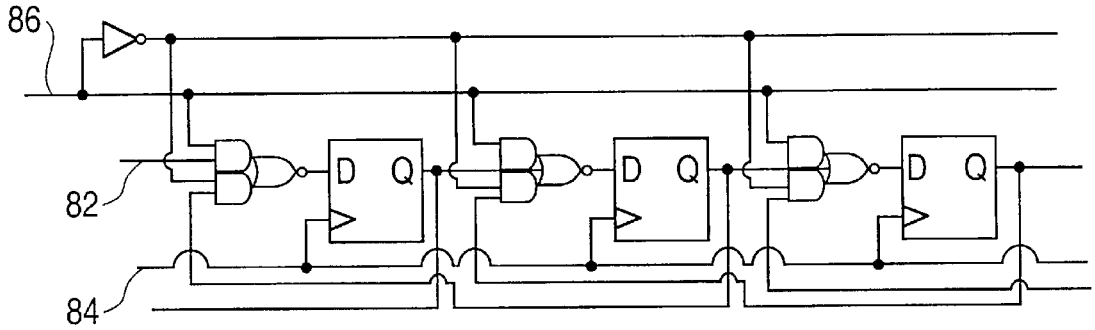
FIG. 4(A) and FIG. 4(B) are circuit diagrams of the shift register 24.
Figure 4B:
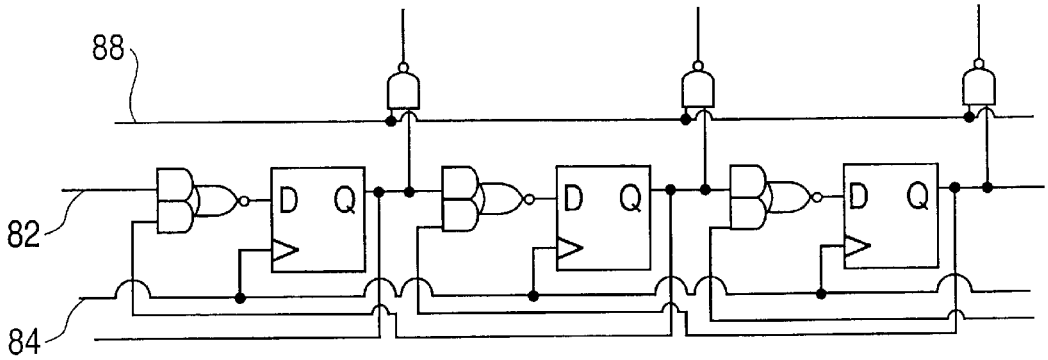

FIG. 4(A) illustrates an embodiment of the shift register 24 that is responsive to the shift direction control signal of terminal 86. FIG. 4(B) illustrates an embodiment of the shift register 24 that is responsive to the output enable signal of terminal 88.

The output driver 26 is comprised of, for example, a buffer. The buffer receives the output signals from the shift register 24 and transfers the received output signals to the display panel part 10.

The structure of the gate drivers 30, 40 and 50 are substantially the same. The gate driver 30 is comprised of a shift register 34, an output driver 36, an input pad 373, input pads 371, and an output pad 375. The gate driver 40 is comprised of a shift register 44, an output driver 46, an input pad 473, input pads 471, and an output pad 475. The gate driver 50 is comprised of a shift register 54, an output driver 56, an input pad 573, input pads 571, and an output pad 575. The structure of the shift registers 34, 44 and 54 have the same structure as the shift register 24. The output drivers 36, 46 and 56 have the same structure as the output driver 26. The level converted control signal (the clock signal, the shift direction control signal and the output enable signal) converted by the level shifter 22 in the gate driver 20 are inputted to the shift registers 34, 44 and 54. That is, each of the gate drivers 34, 44 and 54 has input pads 371, 471 and 571 receiving the output signals from the level shifter 22.

The output signal output from the flip-flop 24-n. as the last stage in the shift register 24, is inputted to the shift register 34 through the output pad 275, a wiring 92, and the input pad 373. The signal on the wiring 92 is used for the data signal of the shift register 34. The output signal output from the flip-flop at the last stage in the shift register 34 is inputted to the shift register 44 through the output pad 375, a wiring 94, and the input pad 473. The signal on the wiring 94 is used for the data signal of the shift register 44. The output signal output from the flip-flop at the last stage in the shift register 44 is inputted to the shift register 54 through the output pad 475, a wiring 96, and the input pad 573. The signal on the wiring 96 is used for the data signal of the shift register 54. The output signal output from the flip-flop at the last stage in the shift register 54 can be output externally through the wiring 98 and the output pad 575. In the preferred embodiment, however, the signal on the wiring 98 is not used.

The operation of the gate drivers 20, 30, 40 and 50 will be explained hereinafter. The data signal, the clock signal, the shift direction control signal, and the output enable signal are applied to the input pads 273 respectively. The data signal on the input pad 273 is transferred to the level shifter 22 through the wiring 72. The clock signal on the input pad 273 is transferred to the level shifter 22 through the wiring 74. The shift direction control signal on the input pad 273 is transferred to the level shifter 22 through the wiring 76. The output enable signal on the input pad 273 is transferred to the level shifter 22 through the wiring 78. In the gate driver 20, the voltage level of the data signal and the voltage level of the control signal are converted by the level shifter 22. The level converted control signal is transferred to the shift register 24, the shift register 34 in the gate driver 30, the shift register 44 in the gate driver 40, and the shift register 54 in the gate driver 50.

The level converted data signal converted by level shifter 22 is inputted to the shift register 24. The shift register 24 stores the data signals successively and outputs them to the output driver 26 and the shift register 34 in response to the clock signal. The data signal transferred through the shift register 24 is output from the output pad 275 to the shift register 34. The shift register 34 stores the data signals successively and outputs them to the output driver 36 and the shift register 44 in response to the clock signal. The data signal transferred through the shift register 34 is output from the output pad 375 to the shift register 44. The shift register 44 stores the data signals successively and outputs them to the output driver 46 and the shift register 54 in response to the clock signal. The data signal transferred through the shift register 44 is output from the output pad 475 to the shift register 54. The shift register 54 stores the data signals successively and outputs them to the output driver 56 in response to the clock signal. Each of the output drivers 26, 36, 46 and 56 receives the data signals and outputs output signals which correspond to the received data signals in parallel form. The output signals of the output drivers 26, 36, 46 and 56 are supplied to gate electrodes of TFT transistors, which comprise the display panel part 10. As a result, the display panel part 10 is driven by the output drivers 26, 36, 46 and 56.

As explained above, the first preferred embodiment has the gate driver 20 having the level shifter 22 and the other gate drivers 30, 40 and 50 having no level shifters. The gate driver 20 can output the output signals of the level shifter 20 from the output pads 271 to the other gate drivers 30, 40 and 50. The other gate drivers can receive the output signals of the level shifter 20 from the input pads 371, 471 and 571. Therefore, only one level shifter, as the level converting means, is required in the display unit.

The level shifter executes a comparing operation which consumes a lot of current. The time period of the comparing operation depends on the amount of current which flows into the level shifter The response ability of the level shifter defines the time period. So, by increasing the current, the time period can be reduced. However, such increased current consumption is to be avoided when possible.

As is understood by those skilled in the art, a flip-flop is comprised of inverters and/or transmission gates which do not execute such a comparing operation. Furthermore, the flip-flop operates more quickly than the level shifter without increasing the current consumption. Therefore, the current consumption of the shift register is very small compared with the level shifter. The current consumption of the output driver (output buffer) is also very small compared with the level shifter.

In the preferred embodiment, the display unit has four gate drivers and one level shifter. That is, the number of level shifters can be reduced from four level shifters/four gate drivers to one level shifter/four gate drivers. Since the conventional display driver positions the level shifter to receive the shift register output, the conventional display unit has one level shifter per one gate driver. Consequently, the current consumption of the display unit of the present invention can be reduced compared to the conventional display unit. Furthermore, the number of circuit elements for driving the display panel part can also be reduced.

In the gate drivers having no level shifter, there are only provided input pads for receiving the level converted control and data signals, instead of a separate level shifter. Therefore, the size of the gate driver itself can be reduced. Furthermore, it is easy to produce the gate driver; because it is not necessary to include the level shifter on a single chip. Furthermore, the size of the display unit can be reduced since the size of the gate driver is reduced.

It is to be understood that the shift register and the level shifter are not intended to be limited to the above examples. Variations may be made by one skilled in the art as far as the variations can achieve the advantages of the present invention.

Second Embodiment

A drive circuit and a display unit according to a second preferred embodiment of the present invention will be explained hereinafter with reference to the figures.

Figure 5:
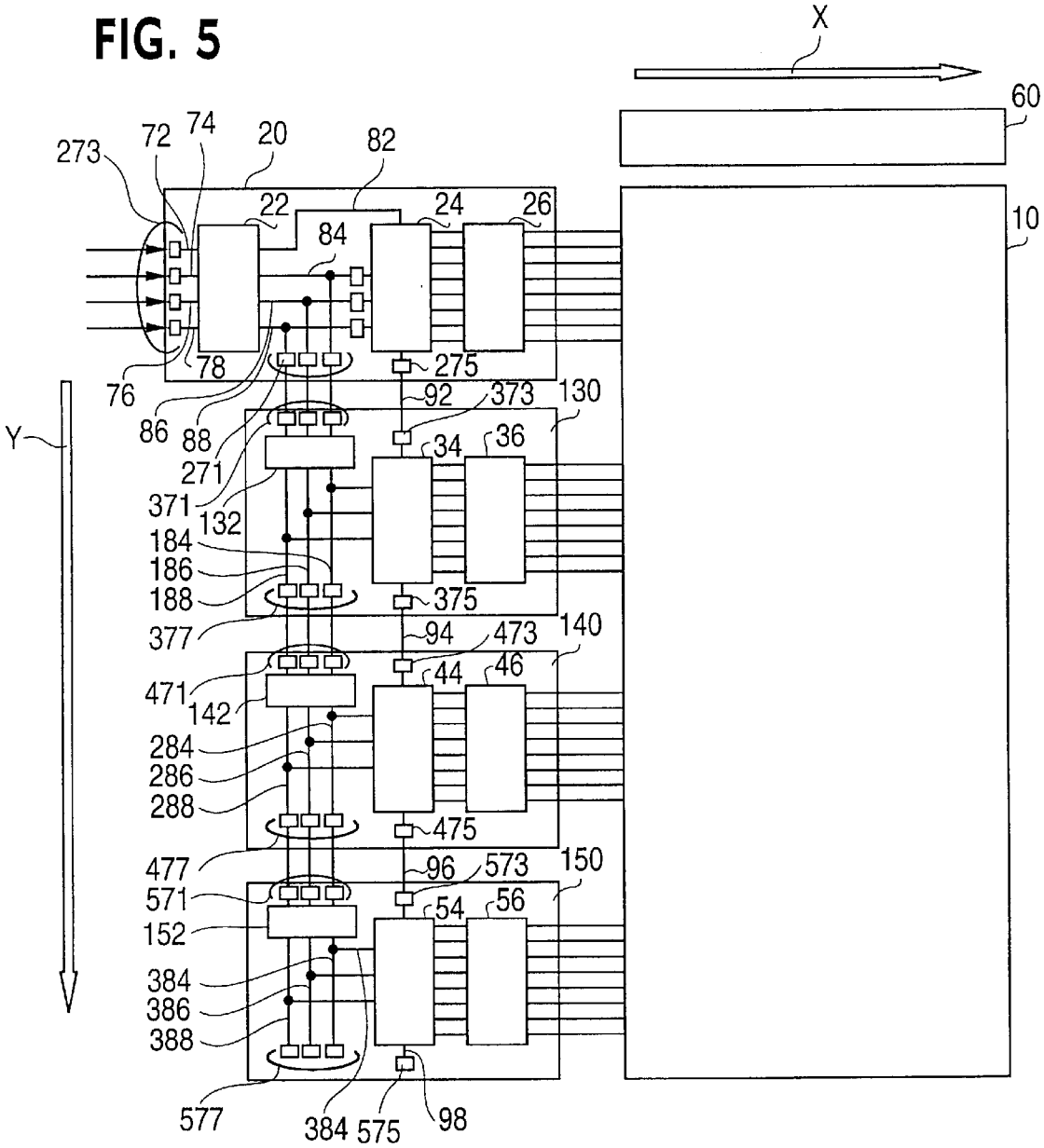
FIG. 5 is a block diagram of the drive circuit and the display unit according to a second preferred embodiment.

FIG. 5 is a block diagram showing a display device that has the display panel part 10 and a drive part for the panel 10 according to the second preferred embodiment of the present invention. In this preferred embodiment, the display panel part 10 is also TFT liquid crystal display panel. In FIG. 5, wherein like elements are given like reference characters in FIG. 1.

This embodiment is similar to that described above with the exception that it provides gate drivers 130, 140 and 150. The gate drivers 130, 140 and 150 have the same structure each other.

The gate driver 130 has a buffer circuit 132. The shift register 34 and the output driver 36 in the gate driver 130 have the same structure as the shift register and the output driver in the gate driver 30 respectively.

The buffer circuit 132 which is connected between the input pads 371 and the shift register 34, and which receives the level converted control signal (the clock signal, shift direction control signal and the output enable signal) through the input pads 371.

Figure 6:
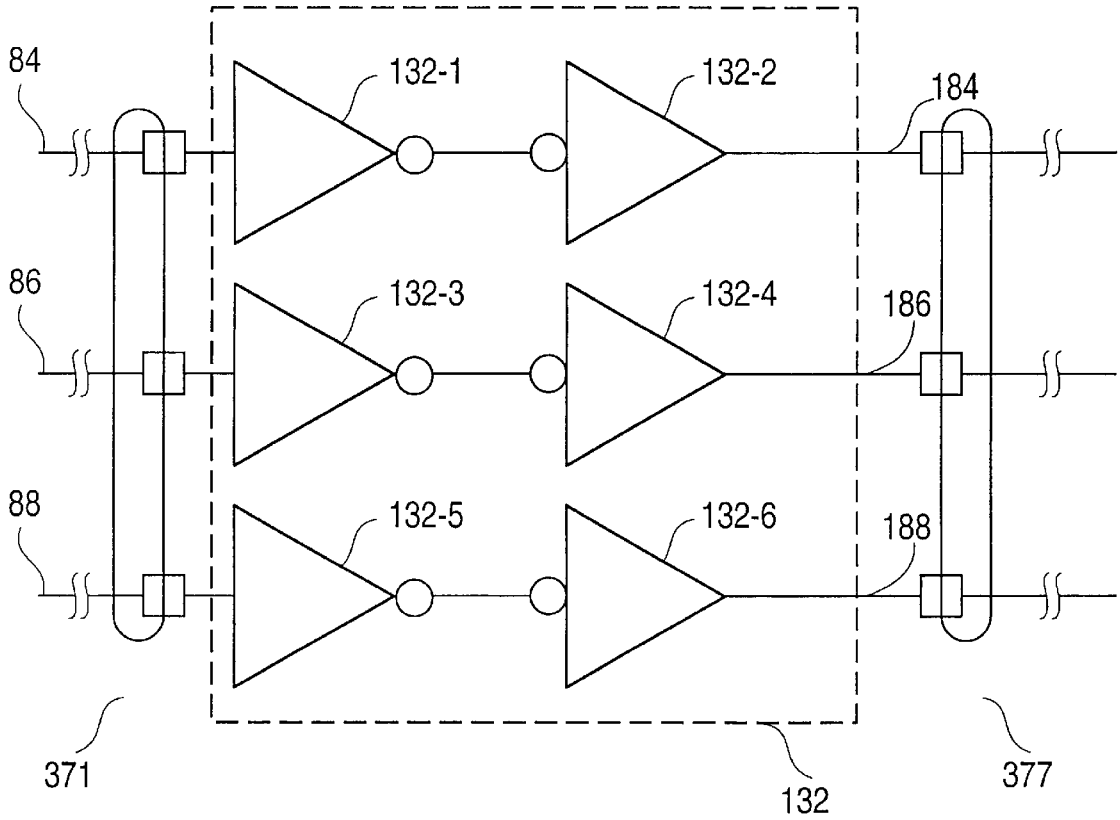
FIG. 6 is a circuit diagram of the buffer circuit 132.

FIG. 6 shows a circuit diagram of the buffer circuit 132. The buffer circuit 132 is comprised of inverters 132-1 to 132-6. An input terminal of the inverter 132-1 is connected to one of the input pads 371. An input terminal of the inverter 132-2 is connected to an output terminal of the inverter 132-1. A signal output by the inverter 132-2 is transferred to the wiring 184. An input terminal of the inverter 132-3 is connected to one of the input pads 371. An input terminal of the inverter 132-4 is connected to an output terminal of the inverter 132-3. A signal output by the inverter 132-4 is transferred to the wiring 186. An input terminal of the inverter 132-5 is connected to one of the input pads 371. An input terminal of the inverter 132-6 is connected to an output terminal of the inverter 132-5. A signal output by the inverter 132-6 is transferred to the wiring 188. The waveform of the signal (clock signal) which is transferred through the wiring 84 to the pad 371, is shaped by the inverters 132-1 and 132-2. The waveform of the signal (shift direction control signal) which is transferred through the wiring 86 to the pad 371, is shaped by the inverters 132-3 and 132-4. The waveform of the signal (output enable signal) which is transferred through the wiring 88 to the pad 371, is shaped by the inverters 132-5 and 132-6.

The control signal received by the gate driver 130 is transferred to the shift register 34 through the buffer circuit 132. The control signal on the wirings 184, 186 and 188 is output from output pads 377 to input pads 471.

The buffer circuit 142 in the gate driver 140 has the same structure as the buffer circuit 132. The shift register 44 and the output driver 46 in the gate driver 140 have the same structure as the shift register and the output driver in the gate driver 40 in FIG. 1.

The control signal on the input pads 471 is transferred to the shift register 44 through the buffer circuit 142. The control signal on the wirings 284, 286 and 288 is output from output pads 477 to input pads 571.

The buffer circuit 152 in the gate driver. 150 has the same structure as the buffer circuit 132. The shift register 54 and the output driver 56 in the gate driver 150 have the same structure as the shift register and the output driver in the gate driver 50 respectively.

The control signal on the input pads 571 is transferred to the shift register 54 through the buffer circuit 152. The control signal on the wirings 384, 386 and 388 can be output externally from output pads 577, however, this signal is not used in this embodiment.

The basic operation of such gate driver unit having the gate driver 20, 130, 140 and 150 and the operation of the gate driver unit in the first preferred embodiment are substantially the same.

Figure 7:
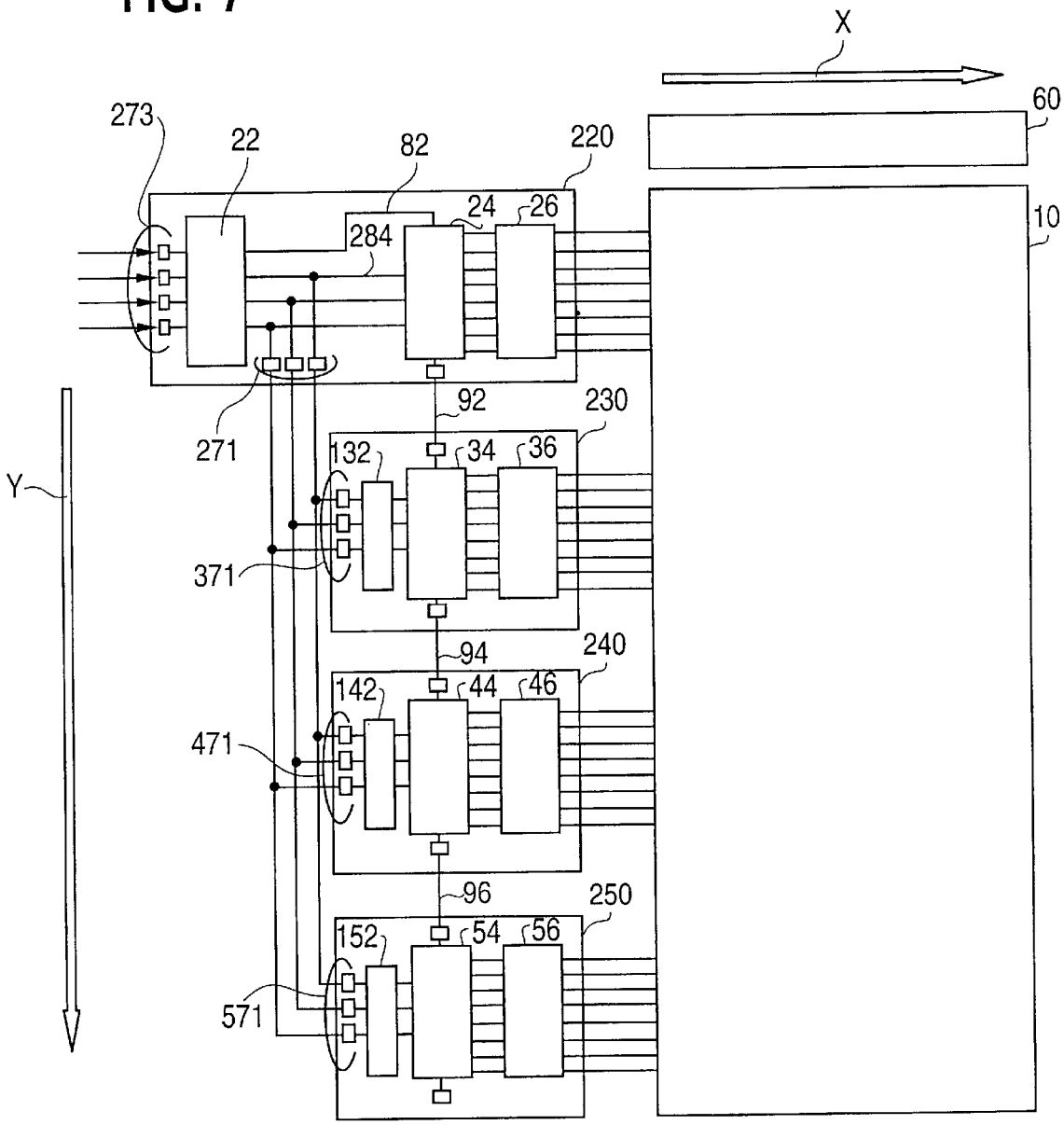
FIG. 7 is a block diagram of a modified drive circuit and the display unit.

In the second preferred embodiment, the current consumption of the drive circuit (the gate driver) can be reduced. In addition, the malfunction that is based on the attenuation of the control signal transferred through the gate drivers 130, 140 and 150 can be prevented. Such malfunction is called a fun-out problem. It is well known that such problems occur in the case where one control signal is supplied to a plurality of circuits. In the second preferred embodiment, such problem can be solved without adding a large circuit. The buffer circuits in the second preferred embodiment may be provided to the wirings 92, 94 and 96. Furthermore, the second preferred embodiment can be modified as illustrated in FIG. 7.

Third Embodiment

A drive circuit and a display unit according to a third preferred embodiment of the present invention will be explained hereinafter with reference to the figures.

Figure 8:
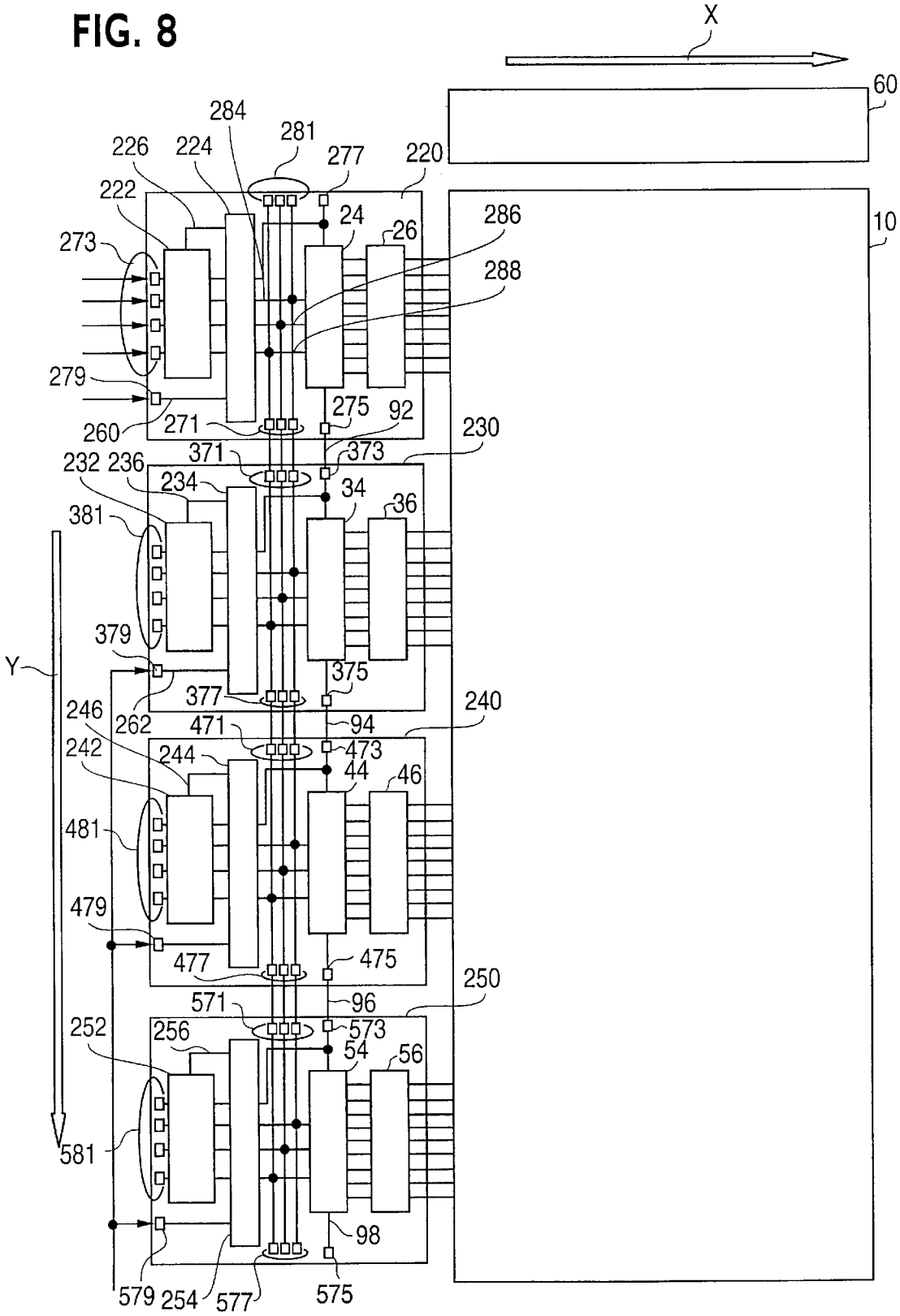
FIG. 8 is a block diagram of the drive circuit and the display unit according to a third preferred embodiment.

FIG. 8 is a block diagram showing a display device that has the display panel part 10 and a drive part for the panel 10 according to the third preferred embodiment of the present invention. In this preferred embodiment, the display panel part 10 is also TFT liquid crystal display panel. In FIG. 8, wherein like elements are given like reference characters in FIG. 1.

This embodiment is similar to that above described with the exception that it provides gate drivers 220, 230, 240 and 250. The gate drivers 220, 230, 240 and 250 have the same structure each other.

First, the gate driver 220 will be explained hereinafter.

The gate driver 220 has an operation control circuit 224 for controlling an operation of the level shifter 222, the shift register 24, the output driver 26, an input pad 277, an input pad 279, the input pads 273, input pads 281, and the output pad 275 and the output pads 271. The level shifter 222 has the same structure as the level shifter 22 in FIG. 1. The shift register 24 and the output driver 26 in the gate driver 220 have the same structure as the shift register and the output driver in FIG. 1 respectively.

Figure 9:
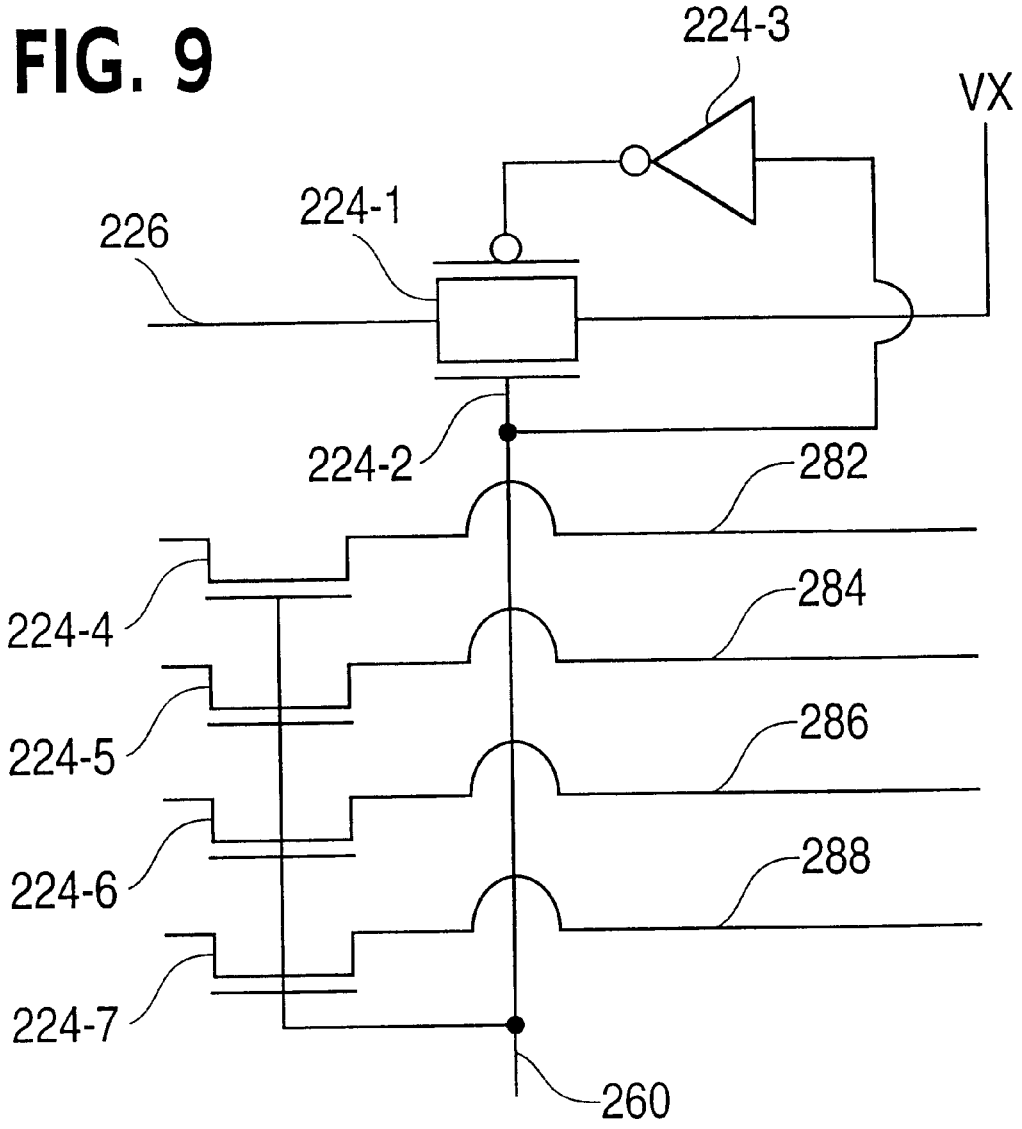
FIG. 9 is a circuit diagram of the operation control circuit 224.

The operation control circuit 224 controls the operation of the level shifter 222 in response to an operation control signal on a wiring 260 (on the input pad 279). FIG. 9 shows a circuit diagram of the operation control circuit 224. The operation control circuit 224 is comprised of a p-type MOS transistor 224-1, n-type MOS transistors 224-2 and 224-4 to 224-7 and an inverter 224-3. The transistor 224-1 has one electrode receiving the high voltage VX, another electrode connected to a wiring 226, and a gate electrode connected to the inverter 224-3. The transistor 224-2 has one electrode receiving the high voltage VX, another electrode connected to the wiring 226, and a gate electrode connected to the wiring 260. The wiring 226 is used for the high voltage supply line which supplies the high voltage VX to the level shifter 222 (this line supplies the high voltage VX to transistors 22-1 and 22-2 as shown in FIG. 2). The transistor 224-4 has one electrode applied to one output of the level shifter 222, it is the data signal, another electrode connected to the wiring 282, and a gate electrode connected to the wiring 260. The transistor 224-5 has one electrode receiving one output of the level shifter 222, it is the clock signal, another electrode connected to the wiring 284, and a gate electrode connected to the wiring 260. The transistor 224-6 has one electrode receiving one output of the level shifter 222, it is the shift direction controlling signal, another electrode connected to the wiring 286, and a gate electrode connected to the wiring 260. The transistor 224-7 has one electrode receiving one output of the level shifter 222, it is the output enable signal, another electrode connected to the wiring 288, and a gate electrode connected to the wiring 260.

In FIG. 9, when an operation control signal having the high voltage VX level is applied to the wiring 260 (the input pad 279), the transistors 224-1 and 224-2 are conductive, thus, the high voltage VX is transferred to the wiring 226 through the transistors 224-1 and 224-2. The level shifter 222 becomes enable, because the high voltage level VX is applied thereto through the wiring 226. Since transistors 224-4 to 224-7 become conductive in response to the operation control signal having the high voltage VX level, the data and the control signals converted by the level shifter 222 are transferred to the wirings 282, 284, 286 and 288 respectively.

The signals transferred to the wirings 282, 284, 286 and 288 are inputted to the shift register 24. Especially the control signal (the clock signal, the shift direction controlling signal and the output enable signal) on the wirings 284, 286 and 288 is also output to an external circuit. That is, the gate driver 220 has the output pads 271 for outputting the control signal on the wirings 284, 286 and 288.

The gate driver 230 has a level shifter 232, an operation control circuit 234, the shift register 34, the output driver 36, the input pads 371, 373, 379 and 381, and the output pads 375 and 377. The level shifter 232 has the same structure as the level shifter 222. The shift register 34 has the same structure as the shift register 24. The output driver 36 has the same structure as the output driver 26.

The operation control circuit 234 has the same structure as the operation controlling circuit 224. But the gates of the transistors 224-2 to 224-7 of the operation control circuit 234 receive a signal having a complementary voltage level (the ground voltage level) against the signal on the wiring 260. When the wiring 262 (the input pad 379) receives the operation control signal having the ground voltage level, the transistors 224-1 and 224-2 are nonconductive. Therefore, the operation control circuit 234 inhibits that the high voltage VX is transmitted to the wiring 226 through the transistors 224-1 and 224-2. (That is, the high voltage VX is not transferred to the wiring 226.) At this time, the level shifter 232 does not operate, because the high voltage VX is not applied thereto. In such structure, the wrong transmission that the output of the level shifter is transferred to the shift register according to the undesirable noise can be prevented.

The gate driver 230 has the input pads 371 which receive the signals on the wirings 284, 286 and 288.

The gate drivers 240 and 250 have substantially the same structure as the gate driver 230. The level shifters 242 and 252 have the same structure as the level shifter 232. The operation control circuits 244 and 254 have the same structure as the operation control circuit 234. The shift registers 44 and 54 have the same structure as the shift register 34. The output drivers 46 and 56 have the same structure as the output driver 36.

In this preferred embodiment, the gate driver 250 has the output pads 577 for outputting the signal transferred from the wirings 284, 286 and 288 to an external circuit, however, the output pads 577 are not used to output the signal. Furthermore, the gate driver 220 has the input pads 281 and the input pad 277 for inputting signals from an external circuit, however, the input pads 281 are not used. Furthermore, the gate drivers 230, 240, and 250 have the input pads 381, 481, and 581 respectively, however, these pads are also not used to input signals from an external circuit.

In the third preferred embodiment, the voltage level of the wiring 260 (the voltage level of the operation control signal) is maintained at the high voltage VX. In order to maintain the voltage level of the wiring 260, the wiring 260 or the input pad 279 may be connected to a wiring that supplies the high voltage VX. The voltage level of the wiring 262 is maintained at the ground voltage. In order to maintain the ground voltage level of the wiring 262, the wiring 262 or the input pads 379, 479, and 579, may be connected to a wiring that supplies the ground voltage.

Since the voltage level of the wiring 260 is the high voltage VX, the operation control circuit 224 supplies the high voltage VX to the level shifter 222. Since the voltage level of the wiring 262 is the ground voltage, the operation control circuits 234, 244 and 254 do not supply the high voltage VX to the level shifters 232, 242 and 252. As a result, the drive operation of the gate driver and the display unit for driving the display panel part 10 in the third preferred embodiment and the first preferred embodiment thereof are substantially the same.

In the third preferred embodiment, it can obtained the same advantages of the first preferred embodiment. In addition, the time for developing and producing the product can be reduced, because all gate drivers, which comprise the display unit, have substantially the same structure.

Figure 10:
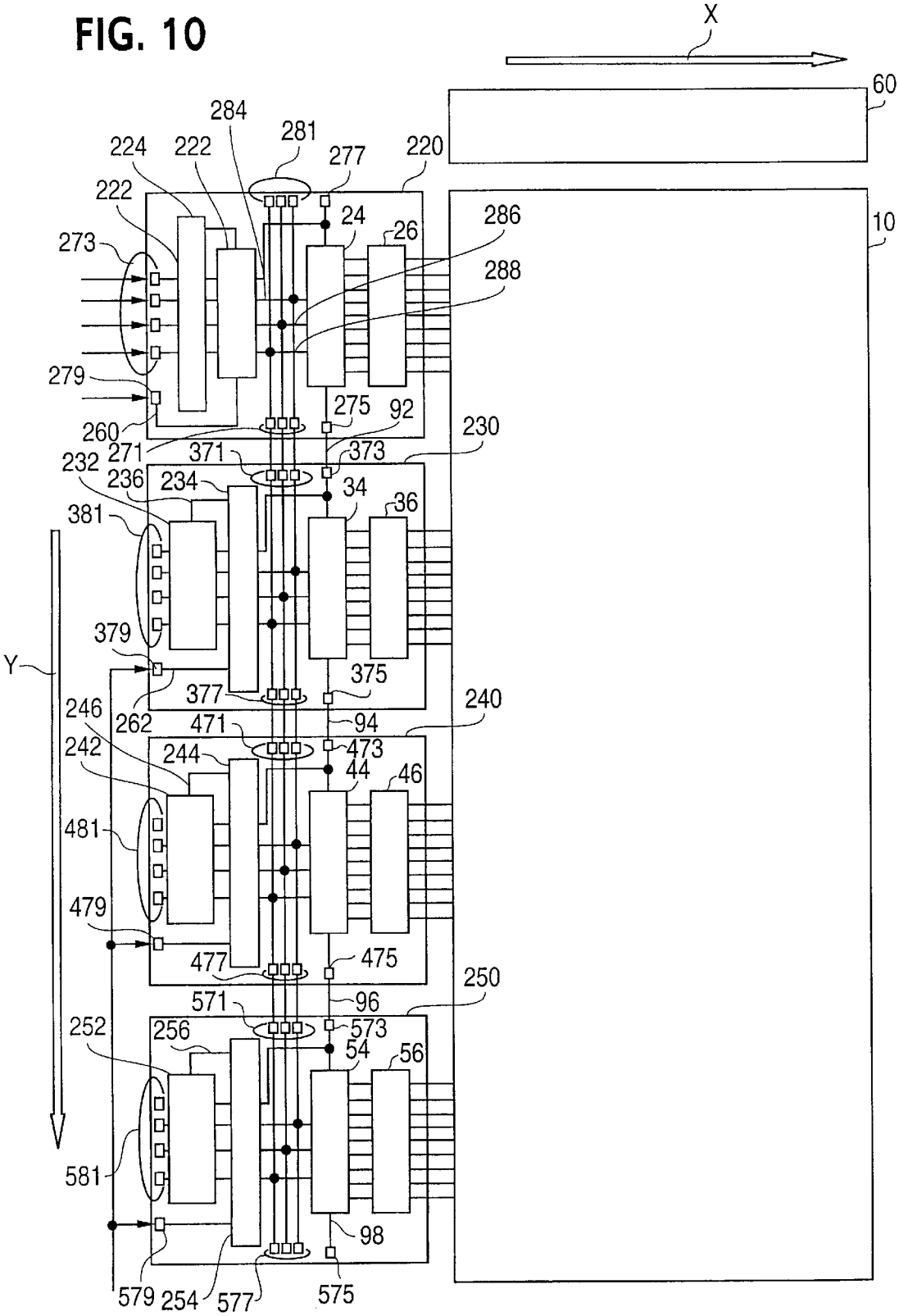
FIG. 10 is a block diagram of a modified drive circuit and the display unit.

The position, in which the operation control circuit 224 is located, may be changed as illustrated in FIG. 10. In this case, the operation control circuit 224 receives the signals on the wirings 72, 74, 76 and 78 and controls whether the operation control circuit 224 transfers the received signals to the level shifter 222 or not. Accordingly, the operation control circuit 224 can be controlled by using the operation signal ranging from the supply voltage level VDD (5 v) to the ground voltage level (0 v). That is, it is not necessary to use the high voltage VX for controlling the operation control circuit 224.

Figure 11:
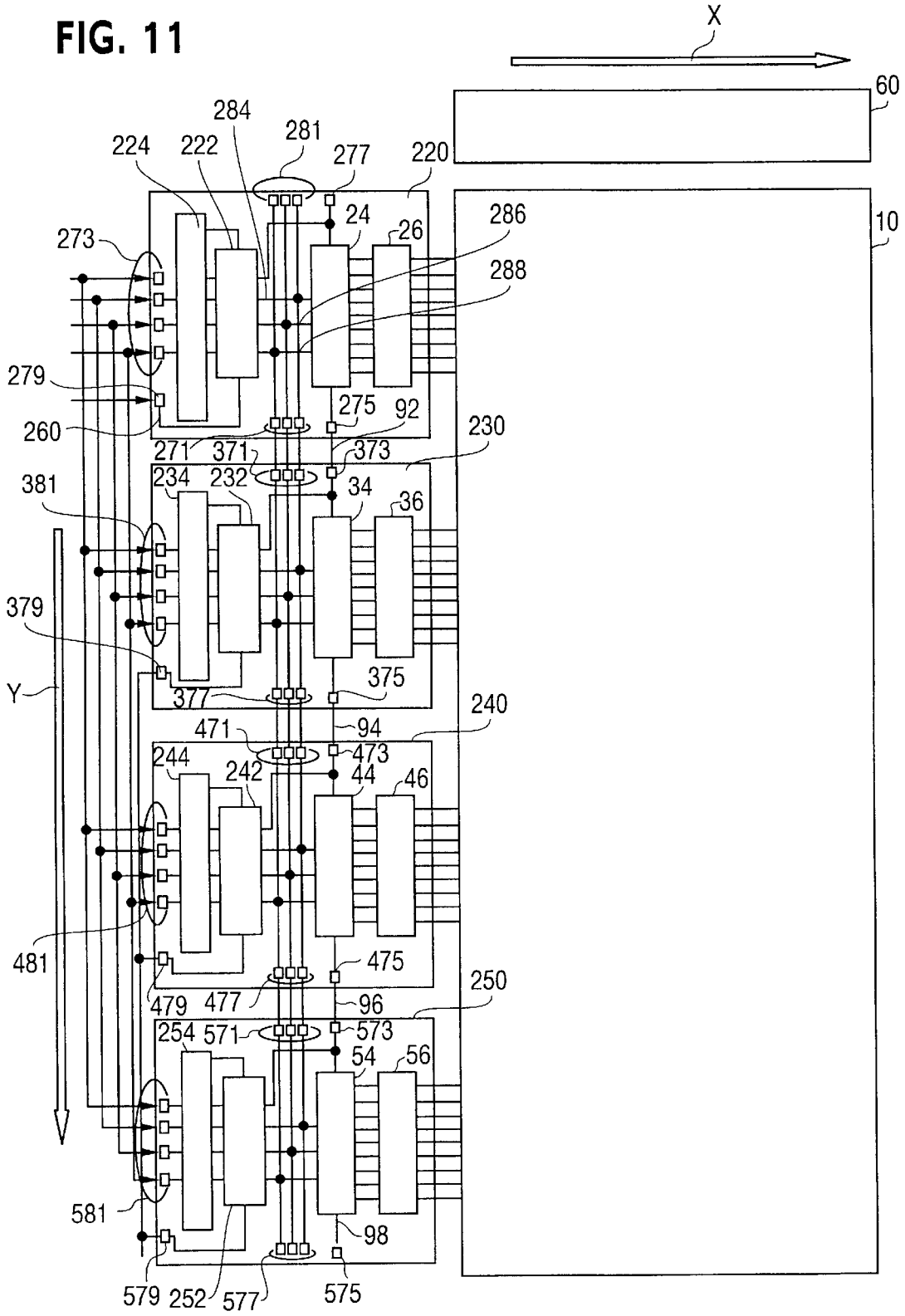
FIG. 11 is a block diagram of a modified drive circuit and the display unit.

Furthermore, the third preferred embodiment can be modified as illustrated in FIG. 11. The modified example has gate drivers which commonly receive the data signal, the control signal from the input pads 273, 381, 481, and 581 respectively.

Fourth Embodiment

A drive circuit and a display unit according to a fourth preferred embodiment of the present invention will be explained hereinafter with reference to the figure.

Figure 12:
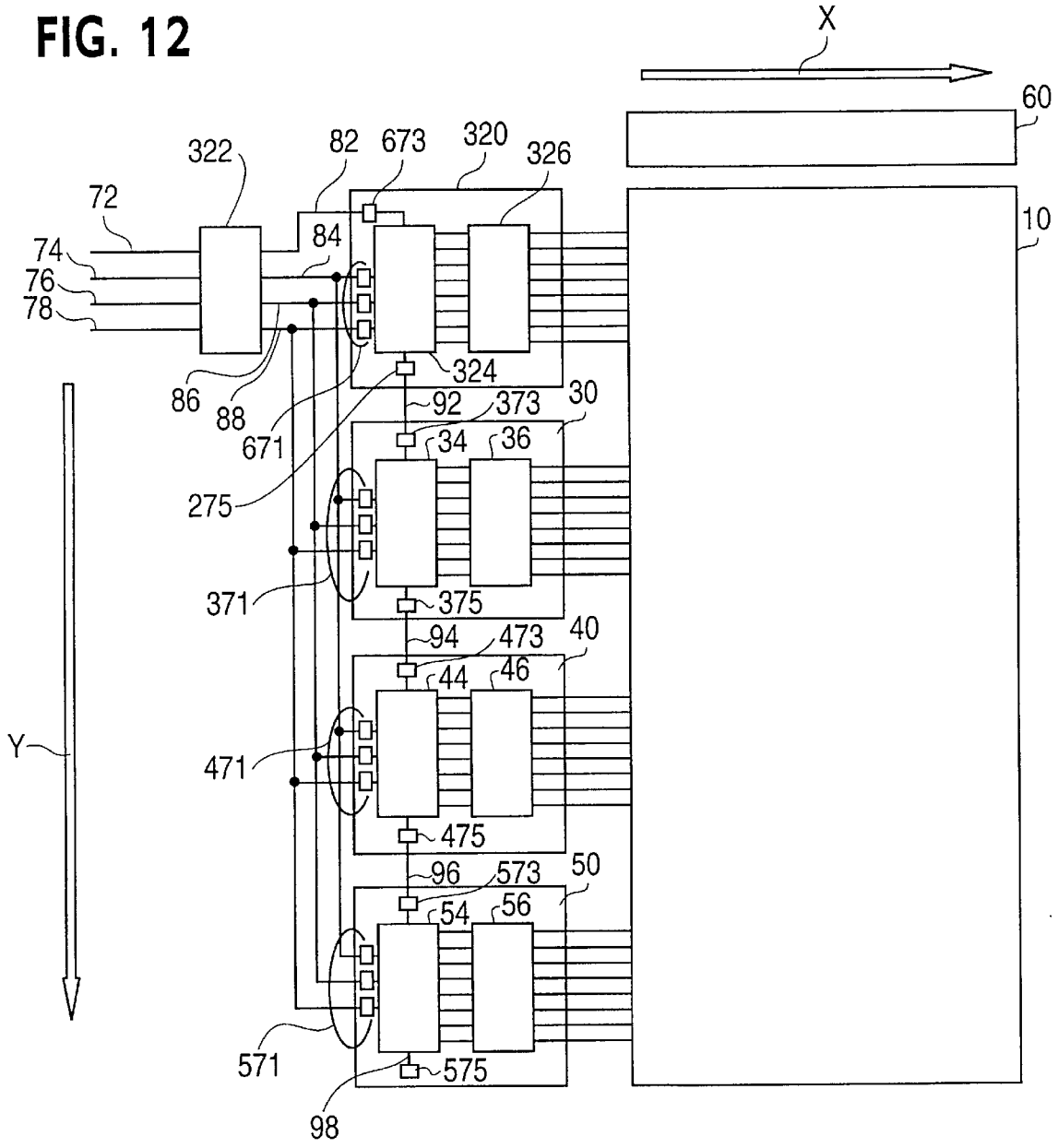
FIG. 12 is a block diagram of the drive circuit and the display unit according to a fourth preferred embodiment.

FIG. 12 is a block diagram showing a display device that has the display panel part 10 and a drive part for the panel 10 according to the fourth preferred embodiment of the present invention. In this embodiment, the display panel part 10 is also TFT crystal liquid display panel. In FIG. 12, wherein like elements are given like reference characters in FIG. 1.

This embodiment is similar to that above described with the exception that it provides gate drivers 320. That is, an integrated circuit 322 is formed in a chip different from a chip in which the gate driver 320 is formed. However, the integrated circuit 322 itself has the same structure as the level shifter 22 in FIG. 1. The gate driver 320 has a shift register 324, an output driver 326, an input pad 673, input pads 671 and the output pad 275. The shift register 324 has the same structure as the shift registers 34, 44 and 54. The output driver 326 has the same structure as the output driver 36, 46 and 56.

The integrated circuit 322 converts (shifts) the levels of the signals which are transferred from the wirings 72, 74, 76 and 78 and transfers the converted signals to the wirings 82, 84, 86 and 88.

The signal (the data signal) on the wiring 82 is inputted to the shift register 324 through the input pad 673. The signals (the clock signal, the shift direction control signal and the output enable signal) on the wirings 84, 86 and 88 are transferred to the shift registers 324, 34, 44 and 54 through the input pads 671.

The drive operation of the display unit for driving the display panel part 10 in the fourth preferred embodiment and the first preferred embodiment thereof are the same.

The fourth preferred embodiment has the integrated circuit 322 that is separated from the gate drivers. Therefore, it can be used the gate drivers 320, 30, 40 and 50 have almost uniform structure each other. As a result, the fourth preferred embodiment can obtain the same advantages as the first preferred embodiment. In addition, the time for developing the gate driver and producing it can be reduced. Furthermore, since the integrated circuit 322 itself as the level converting means is integrated into a single chip, the elements for driving the display panel part 10 can be easily assembled along the display panel part 10.

If the drive circuit and the display unit explained as the first through fourth preferred embodiments use in the portable equipment, the current consumption can be economized. Therefore, it would be possible to extend the operation time of the portable equipment.

The first through fourth preferred embodiments are not intended to be limited to the above examples. For example, the significant feature of the buffer circuit in the second preferred embodiment may be provided to the third and the fourth preferred embodiments. The channel types of transistors are also not limited to the above examples. The transistor having a channel type different from the above examples, but which operates the same way as the above examples, can be included in the scope of the present invention.

Furthermore, the output driver in the drive circuit may include a part of the converting function of the level shifter. For example, in the case where the drive circuit converts the signal having the voltage level ranging from 0 v to 5 v to the signal having the voltage level ranging from 0 v to 30 v, such output driver can operate as follows. The level shifter converts most of level conversion (the level shifter converts the signal having the level ranging from 0 v to 5 v to the signal having the level ranging from 0 v to 20 v) and then the output driver converts rest of level conversion (the output driver converts the signal having the level ranging from 0 v to 20 v to the signal having the level ranging from 0 v to 30 v).

According to the present invention, the drive circuit and the display unit that can reduce the current consumption can be provided. Such drive circuit and such display unit without adding large circuit can be also provided. Furthermore, such drive circuit and such display unit can be provided without no complex development. Such drive circuit and such display unit can be also provided without using complex manufacturing process. Furthermore, such drive circuit and such display unit can be provided without reducing their performance.

While the preferred form of the present invention has been described, it is to be understood that modifications will be apparent to those skilled in the art without departing from the spirit of the invention.

The scope of the invention, therefore, is to be determined solely by the following claims.

What is claimed is:

1. A gate driver for driving a display device in accordance with driving signals, comprising:

a voltage level shift circuit which receives a data signal, an output enable signal and an output driver control signal each having a voltage level defined by a difference between a high-signal voltage and a low-signal voltage, and which increases the voltage level of the data signal, the output enable signal and the output driver control signal to output a voltage level shifted data signal, a voltage level shifted output enable signal and a voltage level shifted output driver control signal;

an output circuit which receives the voltage level shifted data signal and which outputs the driving signals corresponding to the voltage level shifted output driver control signal in response to the voltage level shifted output enable signal;

wherein said output circuit outputs a plurality of the driving signals in parallel and comprises:

a plurality of shift registers each of which stores the voltage level shifted data signal, and each of which outputs the stored data signal in response to the voltage level shifted output enable signal; and a plurality of output drivers which outputs the driving signals corresponding to the stored data signals.

2. The gate driver according to claim 1, wherein said voltage level shift circuit is comprised of first and second transistors each of which has a gate electrode, a first electrode and second electrode, the gate electrode of the first transistor is electrically connected to the first electrode of the second transistor, and the gate electrode of the second transistor is electrically connected to the first electrode of the first transistor.

3. The gate driver according to claim 2, wherein said second electrode of said first and second transistors are supplied to the predetermined voltage.

4. The gate driver according to claim 2, wherein each of said first and second transistors is a P-type MOS transistor.

5. The gate driver according to claim 3, wherein each of said first and second transistors is a P-type MOS transistor.

6. A drive circuit for driving a display device in accordance with driving signals, comprising:

a voltage level shift circuit which receives a data signal, an output enable signal and an output driver control signal each having a voltage level defined by a difference between a high-signal voltage and a low-signal voltage, and which increases the voltage level of the data signal, the output enable signal and the output driver control signal to output a voltage level shifted data signal, a voltage level shifted output enable signal and a voltage level shifted output driver control signal;

an output circuit which receives the voltage level shifted data signal and which outputs the driving signals corresponding to the voltage level shifted output driver control signal in response to the voltage level shifted output enable signal;

wherein said output circuit outputs a plurality of the driving signals in parallel and comprises:

a plurality of shift registers each of which stores the voltage level shifted data signal, and each of which outputs the stored data signal in response to the voltage level shifted output enable signal; and a plurality of output drivers which outputs the driving signals corresponding to the stored data signals.

7. The drive circuit according to claim 6, wherein said voltage level shift circuit is comprised of first and second transistors each of which has a gate electrode, a first electrode and a second electrode, the gate electrode of the first transistor is electrically connected to the first electrode of the second transistor, and the gate electrode of the second transistor is electrically connected to the first electrode of the first transistor.

8. The drive circuit according to claim 7, wherein said second electrodes of said first and second transistors are supplied to the predetermined voltage.

9. The drive circuit according to claim 7, wherein each of said first and second transistors is a P-type MOS transistor.

10. The drive circuit according to claim 8, wherein each of said first and second transistors is a P-type MOS transistor.

11. A gate driver for driving a display device in accordance with driving signals, comprising:

a voltage level shift circuit which receives a control signal which includes a data signal, an output enable signal and a shift direction control signal, and an output driver control signal each having a voltage level defined by a difference between a high-signal voltage and a low-signal voltage, and which increases the voltage level of the data signal, the output enable signal and the output driver control signal to output a voltage level shifted data signal, a voltage level shifted output enable signal and a voltage level shifted output driver control signal;

an output circuit which receives the voltage level shifted data signal and which outputs the driving signals corresponding to the voltage level shifted output driver control signal in response to the voltage level shifted output enable signal;

wherein said output circuit outputs a plurality of the driving signals in parallel and comprises:

a plurality of shift registers each of which stores the voltage level shifted data signal, and each of which outputs the stored data signal in response to the voltage level shifted output enable signal; and a plurality of output drivers which outputs the driving signals corresponding to the stored data signals.

12. The gate driver according to claim 11, wherein said voltage level shift circuit is comprised of first and second transistors each of which has a gate electrode, a first electrode and second electrode, the gate electrode of the first transistor is electrically connected to the first electrode of the second transistor, and the gate electrode of the second transistor is electrically connected to the first electrode of the first transistor.

13. The gate driver according to claim 12, wherein said second electrodes of aid first and second transistors are supplied to the predetermined voltage.

14. The gate driver according to claim 12, wherein each of said first and second transistors is a P-type MOS transistor.

15. The gate driver according to claim 13, wherein each of said first and second transistors is a P-type MOS transistor.

* * * * *